United States Patent [19]

Lincoln et al.

[11] Patent Number: 4,470,237

[45] Date of Patent: Sep. 11, 1984

[54] STRIP SHINGLES WITH FOAMED ASPHALT AS THE TAB SEAL ADHESIVE AND METHOD OF MANUFACTURE

[75] Inventors: William W. Lincoln, Newark; Glenn D. Lamb, Granville, both of Ohio

[73] Assignee: Owens-Corning Fiberglas Corporation, Toledo, Ohio

[21] Appl. No.: 398,535

[22] Filed: Jul. 15, 1982

[51] Int. Cl.[3] ..... E04C 1/00; E04B 2/00; B05D 5/10; B32B 27/40

[52] U.S. Cl. ..... 52/420; 427/208.6; 427/286; 427/373; 428/200

[58] Field of Search ..... 428/200, 423; 427/244, 427/286, 208.6, 208.2, 373; 52/309.5, 419, 420, 518; 106/273, 277, 273 N; 521/83; 366/1, 3, 5

[56] References Cited

U.S. PATENT DOCUMENTS

| | | | |
|---|---|---|---|
| 1,381,118 | 6/1921 | Gerlach | 106/123 R |
| 1,968,281 | 7/1934 | Cale | 52/420 |
| 2,030,135 | 2/1936 | Carpenter | 52/173 R |
| 2,636,834 | 4/1953 | Myers | 366/3 |
| 2,863,405 | 12/1958 | Liebrook et al. | 52/420 |
| 2,901,369 | 8/1959 | Pordes | 106/273 N |
| 4,004,049 | 1/1977 | Horwat et al. | 156/327 |
| 4,399,186 | 8/1983 | Lauderback | 156/337 |

*Primary Examiner*—John E. Murtagh
*Assistant Examiner*—Andrew Joseph Rudy
*Attorney, Agent, or Firm*—Ronald C. Hudgens; Ted C. Gillespie; Paul J. Rose

[57] ABSTRACT

Tab sealant asphalt adhesive is foamed and then dispensed through a nozzle on asphalt shingle material.

2 Claims, 3 Drawing Figures

STRIP SHINGLES WITH FOAMED ASPHALT AS THE TAB SEAL ADHESIVE AND METHOD OF MANUFACTURE

TECHNICAL FIELD

This invention relates generally to residential asphalt roofing shingles, and more particularly to the preapplied solar-activated adhesive for sealing down the tabs when the shingles are installed on a roof of a house.

BACKGROUND ART

Tab sealant asphalt adhesive is conventionally applied to the front or upper surface of asphalt shingle material by print wheels which pick up hot liquid sealant asphalt from a supply trough and print it on the shingle material in broken-line patterns. The process is very sensitive to variations in the temperature of the sealant asphalt and to variations in the tension in the sheet of shingle material. This makes it difficult to accurately control the thickness or the amount of the tab sealant asphalt applied and results in inconsistent performance of the tab sealant asphalt when the shingles are installed on a roof of a house or other building structures. Conventionally the supply of hot liquid sealant asphalt is maintained at about 330° to 350° F. After application to the shingle material, the liquid tab sealant asphalt hardens and becomes an essentially void-free solid.

DISCLOSURE OF THE INVENTION

In accordance with the invention, the tab sealant asphalt adhesive is mechanically foamed before application to the shingle material, and the application is carried out by the use of a dispensing nozzle. Better control of the amount of asphalt applied, processing at a lower temperature of about 300° F., and a saving of 50% or more in the amount of tab sealant asphalt used are achieved.

BRIEF DESCRIPTION OF DRAWINGS

The invention is more completely described hereinafter with reference to the accompanying drawings in which.

BEST MODE OF CARRYING OUT THE INVENTION

Figure 1:
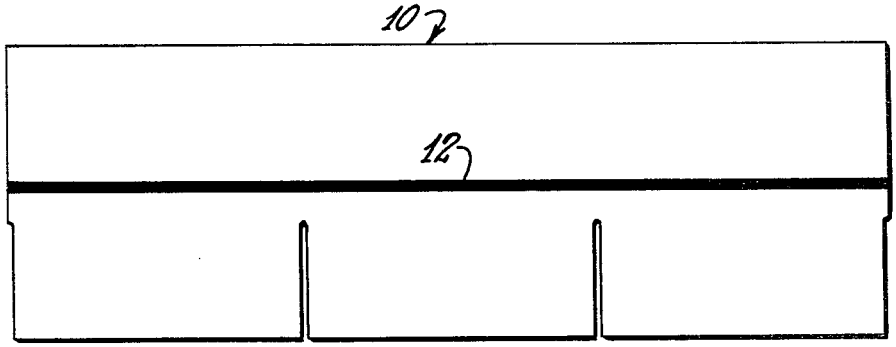
FIG. 1 is a plan view of a shingle with foamed tab sealant asphalt applied in accordance with the invention.

With reference to the drawings, FIG. 1 shows a shingle 10 having a continuous strip 12 of foamed tab sealant asphalt adhesive thereon in accordance with the invention. Alternatively, the strip 12 could be discontinuous or broken.

Figure 2:
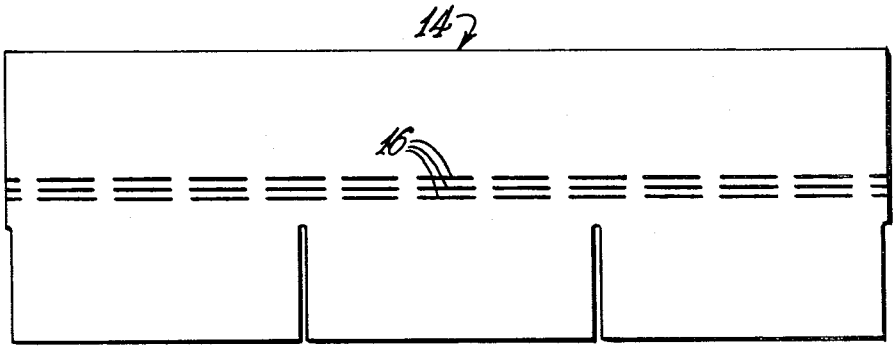
FIG. 2 is a plan view of a shingle showing a different embodiment of the invention.

FIG. 2 shows a shingle 14 having three discontinuous or broken strips 16 of foamed tab sealant asphalt adhesive thereon in accordance with the invention. Alternatively, the three broken strips 16 could be one or two wider strips.

Figure 3:
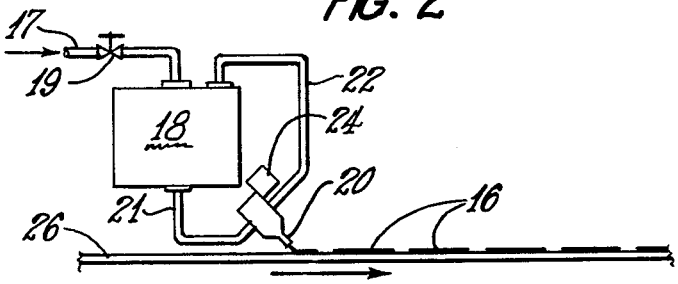
FIG. 3 is a schematic view of the apparatus for and process of foaming and applying tab sealant asphalt to strip shingle material in accordance with the invention.

FIG. 3 shows a supply conduit 17 supplying liquid tab sealant asphalt to a foaming machine 18. A valve 19 is installed in the supply conduit 17. A dispensing nozze 20 is supplied by a supply hose 21 connected to the machine 18 and is provided with a return hose 22 connected to the machine 18. A solenoid 24 is provided for intermittently or continuously opening the nozzle 20 to dispense tab sealant asphalt. Shingle material 26 passes beneath the nozzle 20 and is shown receiving broken strips 16 of the foamed tab sealant asphalt. The shingle material 26 is thereafter cut into separate strip shingles such as the shingles 10 and 14. Normally the shingle material 26 has a width providing three or four lanes of shingles, and therefore three or four of the nozzles 20 are provided.

The foaming machine 18 may be a high-shear mixer, of the type available from EASE, INC. of Tunnel Hill, Ga. 30755, in which radial pins on a rotor are rapidly rotated in interleaving relationship with stationary radial pins on a stator while the liquid being foamed flows axially of the rotor. Actual test results show that savings of 50 percent in the weight of tab sealant asphalt used on the shingles are readily attained, and it is believed that savings of 80 percent are attainable. The voids produced in the asphalt by the foaming machine are retained therein upon solidification of the asphalt and generally are so small as to be invisible to the naked eye. Processing of the asphalt can be carried out at about 300° F.

Various modifications may be made in the structure and process shown and described without departing from the spirit and scope of the invention.

I claim:

1. In an asphalt shingle having a strip of tab sealing adhesive on a normally covered headlap portion thereof for holding down normally exposed overlying tab portions of a shingle in a next upper row when the shingles are installed on a roof, the improvement wherein the tab sealing adhesive is foamed asphalt.

2. In an asphalt shingle manufacturing process including applying a strip of tab sealing asphalt adhesive as a hot liquid on a normally covered headlap portion of a shingle for holding down normally exposed overlying tab portions of a shingle in a next upper row when the shingles are installed on a roof, the improvement comprising foaming the hot liquid asphalt adhesive and dispensing it on the headlap portion of the shingle through a dispensing nozzle.

* * * * *